US006341376B1

(12) United States Patent
Smerdon, Jr.

(10) Patent No.: US 6,341,376 B1
(45) Date of Patent: Jan. 29, 2002

(54) HAND AND WRIST PROTECTOR

(76) Inventor: E. Thomas Smerdon, Jr., 4016 Glenda Pl., Columbus, OH (US) 43220

( * ) Notice: Subject to any disclaimer, the term of this patent is extended or adjusted under 35 U.S.C. 154(b) by 0 days.

(21) Appl. No.: 09/798,306

(22) Filed: Mar. 2, 2001

Related U.S. Application Data

(60) Provisional application No. 60/186,714, filed on Mar. 3, 2000.

(51) Int. Cl.[7] ..... A41D 13/08

(52) U.S. Cl. ..... 2/16; 2/161.1; 128/879

(58) Field of Search ..... 2/16, 20, 21, 24, 2/159, 161.1, 160, 162–163, 910, 455; 128/878, 879; 482/44, 47–49; 602/5, 20, 21, 64

(56) References Cited

U.S. PATENT DOCUMENTS 3,369,258 A * 2/1968 Smith ..... 2/159
4,617,684 A 10/1986 Green et al.
4,850,341 A 7/1989 Fabry et al.
5,004,227 A * 4/1991 Hoffman ..... 272/119
5,081,714 A 1/1992 Mascia
5,214,799 A 6/1993 Fabry
5,267,943 A 12/1993 Dancyger
5,330,391 A * 7/1994 Mitchell ..... 2/161.1
5,397,296 A 3/1995 Sydor et al.
5,515,870 A * 5/1996 Zilber ..... 128/878
5,538,501 A 7/1996 Caswell
5,771,901 A 6/1998 O'Brien
5,826,276 A 10/1998 Garceau-Verbeck
5,829,055 A * 11/1998 Collins et al. ..... 2/22
5,928,172 A 7/1999 Gaylord
6,024,715 A 2/2000 Maxwell
6,098,200 A 8/2000 Minkow et al.

* cited by examiner

*Primary Examiner*—John J. Calvert
*Assistant Examiner*—Tejash Patel

(57) ABSTRACT

A palm and wrist protector for bicycling and other activities requiring hand and wrist protection. A pad of resilient material covers an area of the hand including the base of the thenar eminence, the saddle between the thumb and forefinger, the distal portion of the palm below the base of the fingers, the ulnar side of the palm, and the wrist crease. The pad includes a tubular section that encircles and protects a proximal portion of the wearer's forefinger. An elastic retaining strap holds the protective pad against the palm while allowing the lower edge of the pad to move freely across the wrist during the side to side movement of the hand. In one embodiment, the pad is a laminate construction that includes a pressure distribution plate sandwiched between two coextensive layers of resilient material that are mated together.

12 Claims, 4 Drawing Sheets

HAND AND WRIST PROTECTOR

PRIOR APPLICATION

This application is a continuation in part of U.S. application Ser. No. 60/186,714, filed Mar. 3, 2000.

TECHNICAL FIELD OF INVENTION

The present invention relates generally to ergonomic equipment for protecting hands and wrists, and more specifically to a protective pad for protecting the hands and wrists during bicycling and other activities requiring hand and wrist protection.

BACKGROUND OF THE INVENTION

Hand and finger discomfort and numbness caused by irritation to the ulnar nerve and/or to the median nerve are symptoms experienced by many cyclists. These symptoms can often be alleviated by wearing padded gloves and by frequently changing hand positions on the handlebars. For some cyclists, however, hand pain and numbness is a recurring problem despite these preventative measures. This condition (particularly as it affects the ulnar nerve, which controls sensation to the ring and little fingers) is sometimes referred to as "handlebar palsy" and in serious cases can require medical intervention.

The pain and numbness is typically caused by pressure against the nerve as a result of the rider placing much of his or her upper body weight on the hands when leaning forward in a normal riding position. Riding on rough roads or off-road can exacerbate the problem because of the vibration and shock transmitted to the hands during such riding. Moreover, "road bend" handlebars common to road racing style bicycles, which extend outward from the handlebar stem and then bend forward and downward, can result in pressure to both the ulnar and median nerves depending on the rider's hand position. When a cyclist is grasping the straight top section of road handlebars, the handlebar will be running across the palm and the pressure will be directed mostly against the ulnar nerve. However, when a rider is grasping the brake hoods, the handlebar will usually be running across the valley at the base of the palm and over the wrist crease, potentially causing irritation to the median nerve. In addition, the hand position on the brake hoods can cause discomfort in the area between the thumb and forefinger and along the lower side of the forefinger.

Padded cycling gloves (usually in combination with padded handlebar tape) are widely used by cyclists to reduce hand discomfort while cycling. However, such gloves have significant limitations that prevent them from being an adequate solution for many riders. One limitation is the padding itself, which typically is a thin piece of soft foam or gel material that provides some cushioning and vibration damping, but is limited in its effectiveness by the thinness of the material. Such gloves also lack any stiffener inserts that would cover the palm and help to distribute localized pressure across a wider area of the palm. Furthermore, because the padding in cycling gloves does not extend proximal of the base of the palm or around the lower part of the forefinger (above the knuckle), these gloves offer little or no protection to the wrist area or forefinger when a cyclist's hands are grasping the brake hoods on traditional road-style handlebars.

Examples of gloves similar in style to cycling gloves that are designed to relieve pressure to the median nerve are disclosed in U.S. Pat. No. 4,850,341 to Fabry, et al. (1989) and U.S. Pat. No. 5,214,799 to Fabry (1993). U.S. Pat. No. 6,098,200 to Minkow, et al. (2000) discloses a cycling glove with a cushioning pad that covers the wearer's hypothenar eminance and is intended to provide enhanced protection for the ulnar nerve.

Industrial anti-vibration and impact gloves, like cycling-specific gloves, also suffer from a variety of drawbacks. The visco-elastic polymer inserts commonly used in industrial safety gloves to reduce vibration and absorb shock lack the rigidity needed for effective distribution of pressure across the palm. Industrial anti-vibration gloves also have the disadvantages of being relatively heavy and uncomfortable in warm weather, as well as being comparatively expensive.

For those who suffer from carpal tunnel syndrome, a number of wrist support products are widely available that are designed to prevent or alleviate the symptoms by maintaining the hand in a "neutral" position. These supports will often use one or more rigid or semi-rigid stabilizing stays that extend from the palm to below the wrist and resist any downward bending of the hand. While the palmar stays help to distribute pressure exerted against the wrist, they restrict the wrist movement needed for activities such as cycling, where a rider must be able comfortably to change hand positions on the handlebar, squeeze the brake levers, and grasp a water bottle. In addition, such wrist supports lack a palmar pad for protecting the ulnar nerve. Examples of wrist supports for the prevention of carpal tunnel syndrome are disclosed by U.S. Pat. No. 5,267,943 to Dancyger (1992), U.S. Pat. No. 5,397,296 to Sydor, et al. (1995), U.S. Pat. No. 5,538,501 to Caswell (1996), U.S. Pat. No. 5,928,172 to Gaylord (1999), and U.S. Pat. No. 6,024,715 to Maxwell (2000).

U.S. Pat. No. 4,617,684 to Green, et al. (1986) discloses a flexible palm pad specifically designed to be worn inside a baseball glove or catcher's mitt. The pad has a leather covering on one side and a shock absorbing material on the other side and is held against the palm by two loops, one of which encircles the forefinger and the other the back of the hand. This pad is configured to cushion the distal portion of the palm that is often impacted from catching a baseball, but does not provide protection for the wrist, forefinger, or the saddle between the thumb and forefinger.

U.S. Pat. No. 5,081,715 to Mascia (1992) shows a multiple-layer palm pad assembly that is comprised of a base layer patch of flexible material that extends from the palmar crease to the base of the palm and covers the entire width of the palm including the area at the base of the thumb. The protector is held in place by a pair of straps that extend in opposite directions from opposite edges of the patch and that are secured together around the back of the hand. One or more layers of coextensive, resilient pad material, such as neoprene foam, are then releasably secured to the base layer by means such as hook and loop fasteners. One significant shortcoming of this pad assembly for cycling is that it does not protect the wrist area at the base of the palm, the saddle area between the thumb and forefinger, or the lower part of the forefinger. In addition, the resilient pad material of the assembly lacks the rigidity needed to distribute the localized pressure on the hands resulting from holding the handlebars while leaning forward for extended periods.

In contrast to the above palmar pads, U.S. Pat. No. 5,771,901 to O'Brien (1998) discloses a relatively rigid palmar support that is designed to protect the palm when gripping a bicycle handlebar. The support covers the area of the palm extending from just distal of a distal wrist crease to the proximal side of a palmar crease and from the ulnar side of the hand to a contoured thumb saddle. The thumb saddle curves from the base of the thumb upwardly to an edge portion between the first and second joints of the thumb. The thumb saddle then curves to follow the curvature of the webbed area between the thumb and forefinger when the hand is in a partial gripping position. The palmar support is preferably molded from a material sufficiently rigid to support the rider's weight on the handlebars without substantial flexing. The support is disclosed both as an insert for a cycling glove and as a stand-alone support that is secured by means of a strap that encircles the back of the hand.

The O'Brien '901 palmar support suffers from several drawbacks that significantly limit its versatility. Because it is a molded and relatively rigid plate, it may be uncomfortable to wearers whose hand shape departs from the shape of the mold. Moreover, because it covers the padded area at the base of the thumb, the support would substantially restrict the mobility of the thumb. The rigid form of the support is not well suited to traditional road handlebars, because it does not allow a variety of hand positions on the brake hoods. The thin, rigid edges of the support would also tend to limit the hand flexibility necessary for easy shifting and braking and would tend to be uncomfortable in the gloveless version. The disclosed palmar support does not protect the proximal portion of the forefinger, nor does it offer protection proximal to the distal wrist crease.

U.S. Pat. No. 5,826,276 to Garceau-Verbeck (1998) discloses a hand covering intended to protect the hand from blisters and enhance the wearer's grip during activities such as playing golf and tennis. It includes a flexible palm covering having a dart to accommodate the hump at the heel of the hand and is secured to the hand by a wrist anchor strap, a retaining band that crosses the back of the hand, and optional finger loops. The disclosed grip enhancer is not designed to provide protection from the prolonged pressure and vibration commonly experienced during cycling on the areas of the wrist, palm, forefinger, and webbing between the thumb and forefinger. Furthermore, the separate wrist anchor strap completely encircles the wrist, which prevents the lower portion of the hand covering from moving freely and sliding over the wrist when the hand is moved side to side in the same plane as the forearm. Such radial hand movement, particularly when combined with an inward movement of the hand, can cause the hand covering to bunch up at the base of the palm. Adding a layer of cushioning material to such a hand covering will only exacerbate this bunching problem.

SUMMARY OF THE INVENTION

The present invention provides a comfortable, lightweight, and inexpensive pad for protecting the ulnar and median nerves during cycling and other activities where those nerves are subjected to prolonged pressure and/or to vibration and impact. The pad of the present invention covers the saddle between the thumb and forefinger as well as the lower portion of the forefinger, which are sensitive areas left largely unprotected by the prior art. The present invention also discloses a protective pad comprised of two layers of resilient material with a smaller pressure distribution plate sandwiched between them, thereby providing improved distribution of localized pressure across a broader area of the palm. The smaller dimensions of the pressure distribution plate ensure that the perimeter of the pad remains soft and flexible and that hand and finger mobility are not unduly restricted. Unlike traditional cycling gloves, the present invention also protects the area of the wrist that comes into contact with "road racing" style handlebars when the rider is grasping, or leaning on, the brake hoods. Unlike the prior art, the retaining strap configuration of the present invention does not encircle the wrist, thereby allowing the lower end of the pad to move freely with the hand and accommodate comfortably the side-to-side and inward movement of the hand common during cycling.

It is also an object of the present invention to provide a protective pad that can be comfortably worn by itself, in lieu of gloves, or over gloves, if additional protection is desired. Another object is to provide a palm and wrist protector that can be used effectively in activities other than cycling that require hand and wrist protection. Yet another object of the present invention is to provide a protective pad that is comfortable in warm weather, easy to put on and take off, and that is attractive in its combination of simplicity, functionality, and cost.

DETAILED DESCRIPTION OF THE INVENTION

Figure 1:
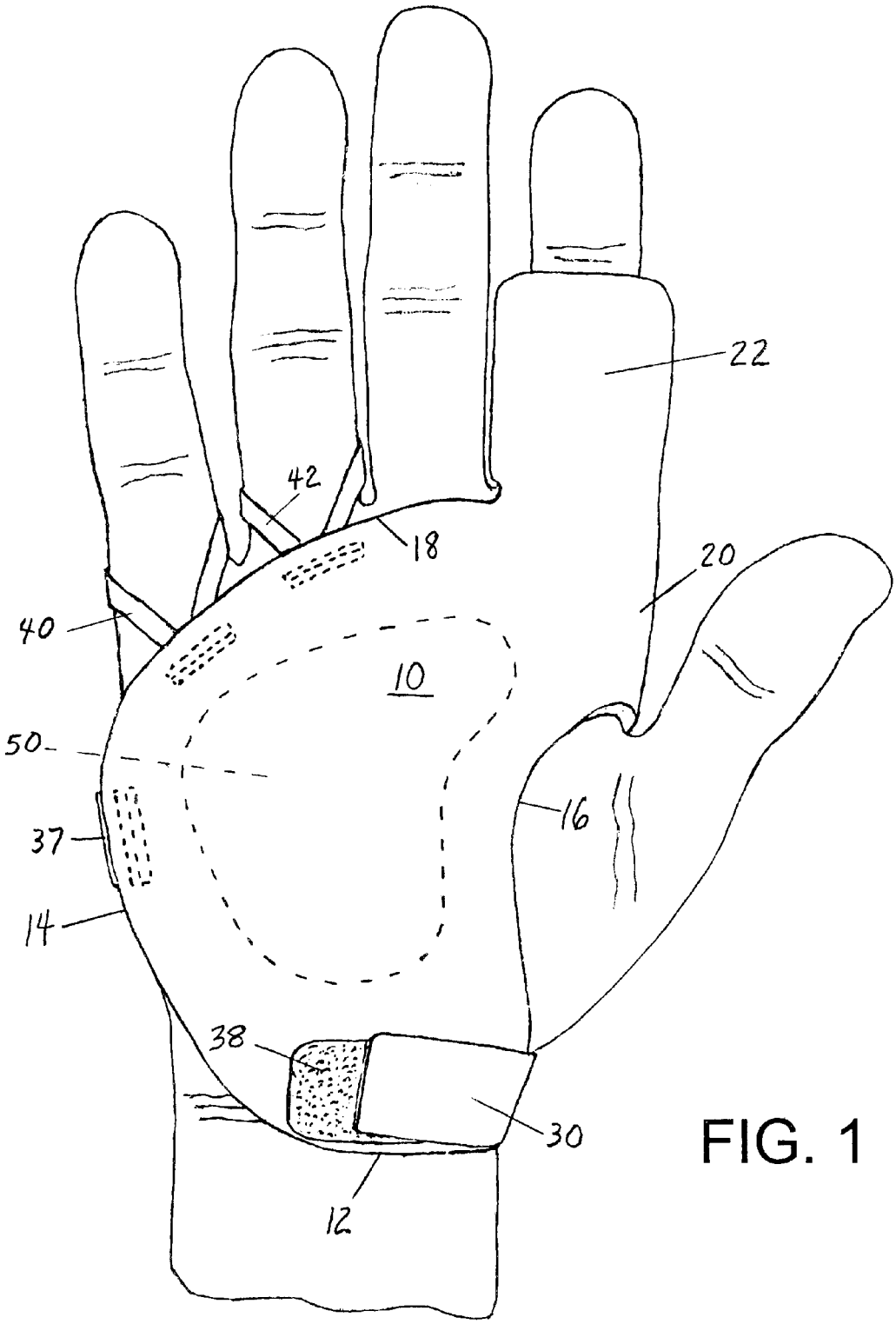
FIG. 1 is a palmar view of a protective palm pad for the right hand.

FIG. 1 shows a palm and wrist pad 10 for the left hand. The right hand pad is a mirror image of the left hand. When secured to the wearer's hand, the lower edge 12 of the pad covers the wrist crease at the base of the palm. From its lower edge, the pad extends on an ulnar edge 14 to substantially cover the hypothenar eminence, and extends on a thumb edge 16 in an inward curve around the thenar eminence and toward the forefinger side of the base of the thumb. A top edge 18 of the pad traverses the palm below the fingers in an arc approximately corresponding to that described by the heads of the metacarpals. The top and thumb edges of the pad extend beyond the webbing between the forefinger and thumb, to form a protective strip 20 that cushions this saddle area when the rider is leaning on or grasping the brake hoods of road handlebars, while still allowing relatively free movement of the thumb. A forefinger protector 22 encircles roughly the lower (proximal) half of the forefinger.

Figure 2:
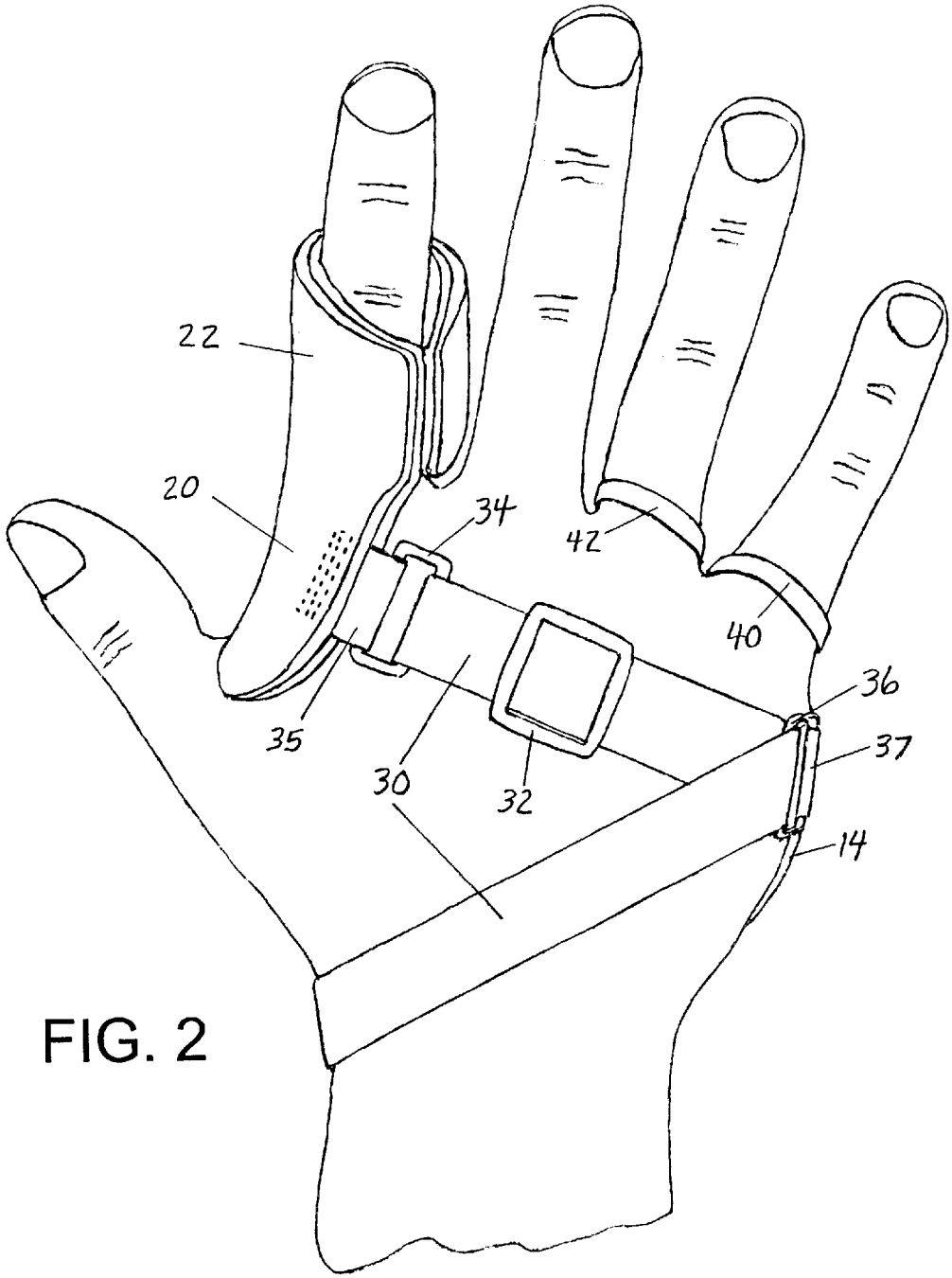
FIG. 2 is a dorsal view of a protective pad of the preferred embodiment.

The preferred elastic retaining strap 30 is shown in FIG. 2. A standard ¾" wide elastic strap has been shown to work well, although other widths may also be utilized. Preferably, the strap has a conventional plastic sliplock buckle 32 affixed to one end and a hook and loop fastener patch sewn to the other end. The strap is preferably secured to the pad by passing one end through a first rectangular strap loop 34 that has been affixed to the edge of the protective strip 20, then through the sliplock buckle, and next through a second strap loop 36. The hook and loop end of the strap is reversed across the back of the hand as illustrated in FIG. 2 and preferrably secured to a complementary hook and loop patch 38 sewn onto the wrist portion of the pad, as shown in FIG. 1. The use of a releasable strap fastener at the pad's wrist portion makes it more convenient for the wearer to remove and put on the pad, while the use of the described sliplock buckle and strap loops allows the wearer both to adjust the tension of the strap and to remove it altogether. However, it can be appreciated that the strap could also be permanently sewn or otherwise affixed to the pad at the three described securement points. In addition, a little finger loop 40 and/or a ring finger loop 42 may be affixed to the pad to help hold it against the palm and to prevent it from sliding. These loops are preferably be made from narrow elastic straps or flat elastic bands and are sewn onto the pad at the appropriate locations.

Figure 3:
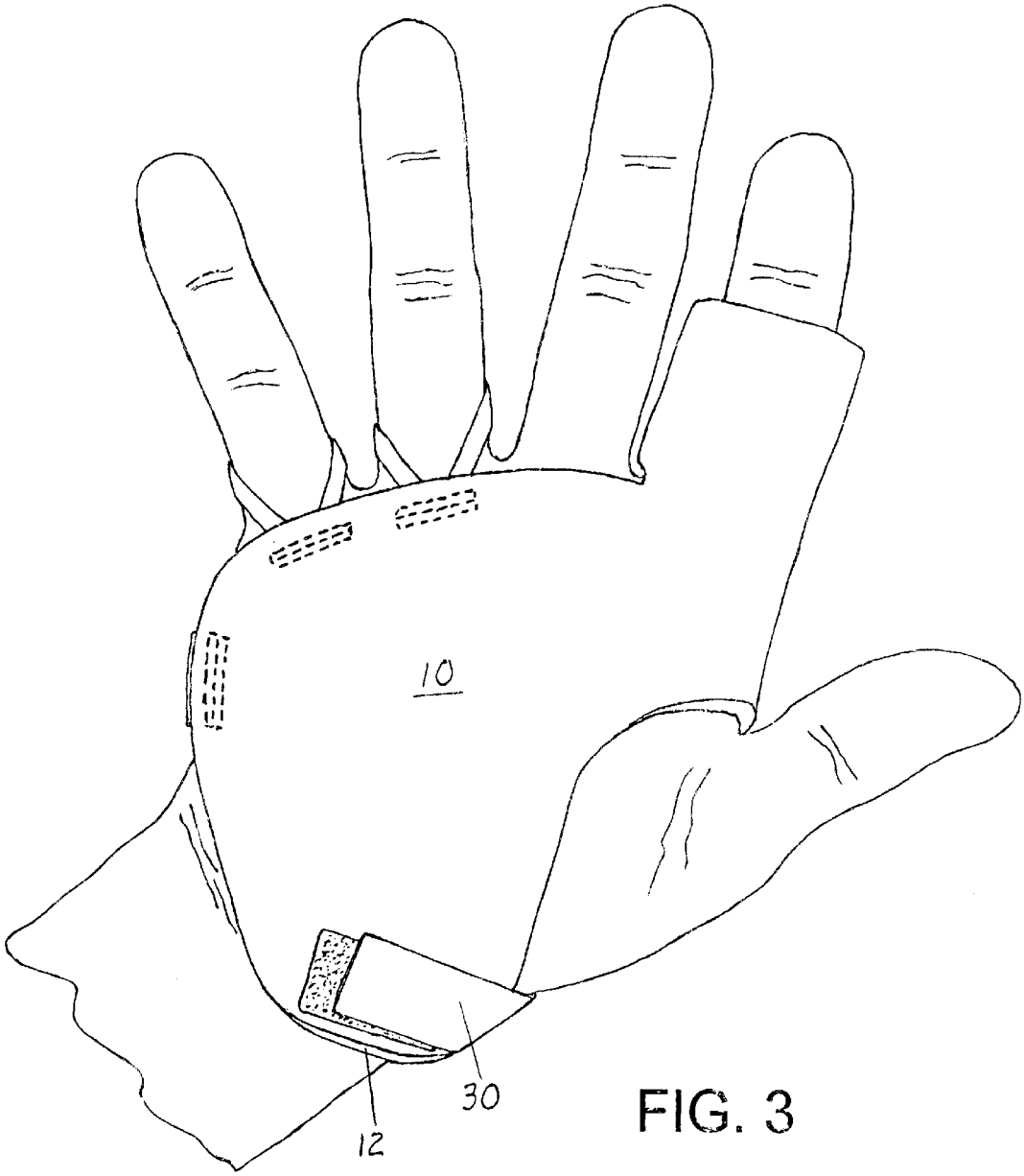
FIG. 3 is a second palmar view of the protective pad showing the wearer's right hand bent radially at an angle to the forearm.

FIG. 3 shows the position of the pad when the wearer's hand is moved radially at an angle to, and in the same plane as, the forearm. The disclosed retaining strap configuration permits the lower edge 12 of the pad to move freely across the wrist during such hand movement.

The pad itself is preferably die cut from closed cell foam or rubber material with sufficient thickness to provide good cushioning and shock absorption properties and sufficient flexibility to allow the protective strip 20 to be folded over the back of the hand and to permit a normal range of hand mobility for braking, shifting gears, and drinking from a water bottle. The use of this material also allows the wearer to trim the pad with scissors if more room around the thumb or a shorter (or no) forefinger protector is desired. A pad thickness in the range of 0.20" to 0.30" has been shown to work well with a medium density material, although other thicknesses may be preferred depending on the closed cell material's properties and special hand protection applications.

Figure 4:
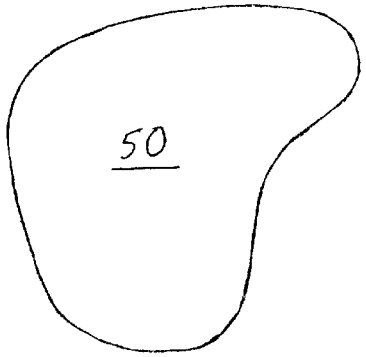
FIG. 4 illustrates the shape of the preferred pressure distribution plate.

The preferred pad is a laminate construction comprised of two identically-shaped and mirror-image pieces with fabric covering on one side and a pressure sensitive adhesive coating on the other side. This construction allows the strap loop tabs 35,37 and finger loops to be sandwiched between the two halves of the pad and then affixed to the pad by sewing. In the preferred embodiment, a pressure distribution plate 50, shown in FIG. 4, is also sandwiched between the two halves. This plate may be cut or stamped from plastic or thin metal sheet material having sufficient rigidity to distribute localized pressure across the palm. By distributing the pressure from leaning on the handlebars, this plate helps to alleviate the compression on the ulnar and median nerves that can lead to hand numbness and discomfort.

Figure 5:
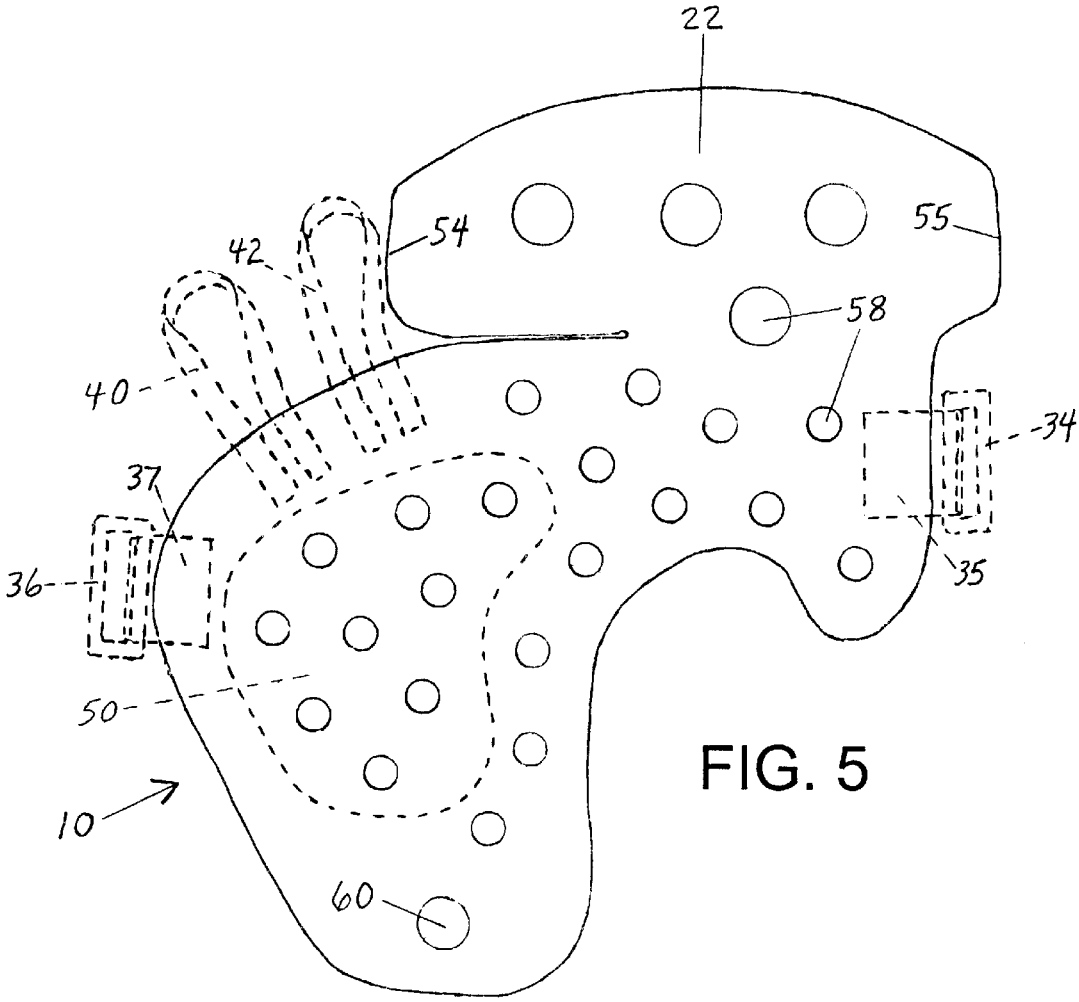
FIG. 5 shows a cutting pattern for the preferred embodiment of the protective pad with example locations for ventilation holes and approximate locations of the strap loop tabs, the finger loops, the pressure distribution plate, and optional magnetic therapy disc.

FIG. 5 shows a cutting pattern for the pad and the approximate locations of the strap loop tabs 35, 37, the finger loops 40, 42, and the pressure distribution plate 50. The tubular forefinger protector 22 is formed by folding and sewing edges 54, 55 together. The right and left hand protective pads are made from identical laminate assemblies by simply folding edges 54, 55 in opposite directions and by sewing fastening patch 38 on opposite sides. A plurality of ventilation holes 58 are also preferably cut or stamped from the pad and pressure distribution plate. These holes help to improve the pad's comfort in warm weather and serve as alignment holes for the pad's assembly. Additionally, an optional "magnetic therapy" version of the pad can be made available by inserting a thin magnet (such as, for example, a plated neodymium-iron-boron magnetic disc) into a suitably-sized opening 60 formed above the pad's lower edge and held between the hook and loop patch on the outside of the pad and a fabric magnet cover sewn to the wrist side of the pad.

While the present invention has been described with respect to specific embodiments, it is to be understood that other modifications and changes may be made to the disclosed embodiments without departing from the spirit and scope of the invention as described above.

I claim:

1. A hand and wrist protector comprising:

A. A pad of resilient material having a shape adapted to substantially cover an area of the wearer's hand and wrist extending over the wrist crease at the base of the palm, along the base of the thenar emininence, over the webbed area between the thumb and forefinger, across the heads of the metacarpals below the palmar base of the fingers, and over the hypothenar eminence on the ulnar side of the palm, and having a section formed in a substantially tubular configuration and adapted to encircle a proximal portion of the wearer's forefinger;

B. An elastic retaining strap extending from a first point of securement to said pad where the pad extends over the webbing between the thumb and forefinger, across the back of the wearer's hand to a second point of securement at a location on the ulnar side of the pad, and then extending in a substantially reversed direction past the base of the thumb to a third point of securement on the wrist portion of said pad.

2. The hand and wrist protector of claim 1 wherein said pad is comprised of two coextensive layers of resilient material mated together.

3. The hand and wrist protector of claim 2 further including a thin pressure distribution plate comprised of rigid or semi-rigid material and having a shape roughly corresponding to, but smaller than, the palmar area of said pad, and sandwiched between the layers of said pad with the perimeter of said plate being within the perimeter of said pad.

4. The hand and wrist protector of claim 3 wherein said pressure distribution plate is comprised of metal or plastic sheet material.

5. The hand and wrist protector of claim 1 further including an elastic retaining loop secured to said pad at a location roughly corresponding to the position of the wearer's little finger and adapted to encircle the base of the wearer's little finger and/or an elastic retaining loop secured to said pad at a location roughly corresponding to the wearer's ring finger and adapted to encircle the base of the wearer's ring finger.

6. The hand and wrist protector of claim 1 wherein said pad is comprised of closed cell foam or closed cell rubber material.

7. The hand and wrist protector of claim 6 further including a fabric covering on one or both outer surfaces of said pad.

8. The hand and wrist protector of claim 1 further including ventilation holes in said pad.

9. The hand and wrist protector of claim 1 wherein said elastic retaining strap is releasably secured to the wrist portion of said pad by means of hook and loop fasteners.

10. The hand and wrist protector of claim 9 wherein said pad further includes a first rectangular strap loop affixed to the portion of said pad that passes over the webbing between the thumb and forefinger and a second rectangular strap loop affixed to the ulnar side of said pad, with said loops having an inside dimension sufficient to allow said elastic retaining strap to pass through the loops.

11. The hand and wrist protector of claim 10 wherein said elastic retaining strap includes a sliplock buckle secured to one end of said strap, with the other end of said strap being adapted to pass through the first strap loop, then through the sliplock buckle, and then through the second strap loop, thereby allowing the tension of the strap to be adjusted and the strap to be detached from the pad.

12. The hand and wrist protector of claim 1 further including one or more magnets having a thickness no greater than the thickness of the pad and secured within suitably-sized holes formed in the wrist portion of said pad.

* * * * *